US012746597B2

(12) United States Patent
Qiao et al.

(10) Patent No.: US 12,746,597 B2
(45) Date of Patent: Sep. 29, 2026

(54) SINTERED ENGINE PART AND METHOD OF MANUFACTURE THEREOF

(71) Applicant: L.E. Jones Company, Menominee, MI (US)

(72) Inventors: Cong Yue Qiao, Menominee, MI (US); David M Doll, Fort Worth, TX (US)

(73) Assignee: L.E. JONES COMPANY, Menominee, MI (US)

( * ) Notice: Subject to any disclaimer, the term of this patent is extended or adjusted under 35 U.S.C. 154(b) by 372 days.

(21) Appl. No.: 18/534,518

(22) Filed: Dec. 8, 2023

(65) Prior Publication Data

US 2024/0131581 A1 Apr. 25, 2024

Related U.S. Application Data

(63) Continuation-in-part of application No. 17/243,821, filed on Apr. 29, 2021, now Pat. No. 11,988,294.

(51) Int. Cl.
*B22F 1/00* (2022.01)
*B22F 1/10* (2022.01)
(Continued)

(52) U.S. Cl.
CPC ..... *B22F 1/09* (2022.01); *B22F 1/10* (2022.01); *B22F 3/12* (2013.01); *B22F 3/24* (2013.01);
(Continued)

(58) Field of Classification Search
CPC ..... B22F 1/09; B22F 1/10; B22F 3/12; B22F 3/24; B22F 2301/35; B22F 2302/10;
(Continued)

(56) References Cited

U.S. PATENT DOCUMENTS 4,836,848 A 6/1989 Mayama et al.
4,970,049 A 11/1990 Baker et al.
(Continued)

FOREIGN PATENT DOCUMENTS

CN 1517518 A 8/2004
CN 10157112 A 8/2009
(Continued)

OTHER PUBLICATIONS

Extended European Search Report dated May 14, 2025, issued by the European Patent Office in corresponding European Application No. 24218143.6-1103, (12 pages).
(Continued)

*Primary Examiner* — Danielle M. Carda
*Assistant Examiner* — Nazmun Nahar Shams
(74) *Attorney, Agent, or Firm* — BUCHANAN INGERSOLL & ROONEY PC

(57) ABSTRACT

A powder admixture useful for making a sintered engine part such as a valve seat insert includes a first iron-base powder and second iron-base powder wherein the first iron-base powder has a higher hardness than the second iron-base powder, the first iron-base powder including, in weight percent, 1-2% C, 10-25% Cr, 5-20% Mo, 15-25% Co, and 30-60% Fe, and the second iron-base powder including a vanadium-free tool steel powder such as a vanadium-free tool steel comprising, in weight %, 1-1.5% C, 3-15% Cr, 5-7% Mo, 3-6% W, and 60-85% Fe, the second iron-base powder further comprising vanadium carbide particles in an amount sufficient to reduce adhesive wear. The powder admixture can be sintered to form a sintered engine part optionally infiltrated with copper.

20 Claims, 1 Drawing Sheet

(51) Int. Cl.
*B22F 3/12* (2006.01)
*B22F 3/24* (2006.01)

(52) U.S. Cl.
CPC ..... *B22F 2301/35* (2013.01); *B22F 2302/10* (2013.01); *B22F 2304/10* (2013.01)

(58) Field of Classification Search
CPC .. B22F 2304/10; B22F 1/142; C22C 33/0242; C22C 33/0285; C22C 38/02; C22C 38/04; C22C 38/22; C22C 38/24; C22C 38/30; C22C 38/36
See application file for complete search history.

(56) References Cited

U.S. PATENT DOCUMENTS 5,031,878 A 7/1991 Ishikawa et al.
5,106,576 A 4/1992 Noda et al.
5,273,570 A 12/1993 Sato et al.
5,312,475 A 5/1994 Purnell et al.
5,462,573 A 10/1995 Baker et al.
5,466,276 A 11/1995 Sato et al.
5,489,324 A 2/1996 Takahasi et al.
5,498,483 A 3/1996 Ito et al.
5,529,602 A 6/1996 Ishii et al.
5,759,227 A 6/1998 Takahashi et al.
5,784,681 A 7/1998 Purnell et al.
5,824,922 A 10/1998 Aonuma et al.
5,834,664 A 11/1998 Aonuma et al.
5,859,376 A 1/1999 Ishibashi et al.
5,870,989 A 2/1999 Takahashi et al.
5,895,517 A 4/1999 Kawamura et al.
5,949,003 A 9/1999 Aoki et al.
6,082,317 A 7/2000 Takashi et al.
6,139,598 A 10/2000 Narasimhan et al.
6,139,599 A 10/2000 Takahashi et al.
6,214,080 B1 4/2001 Narasimhan et al.
6,302,937 B1 10/2001 Hayashi et al.
6,305,666 B1 10/2001 Sakai
6,318,327 B1 11/2001 Takahashi et al.
6,340,377 B1 1/2002 Kawata et al.
6,348,079 B1 2/2002 Choo
6,436,338 B1 8/2002 Qiao
6,613,120 B2 9/2003 Ando et al.
6,641,779 B2 11/2003 Kawase et al.
6,660,056 B2 12/2003 Hayashi et al.
6,676,724 B1 1/2004 Narasimhan et al.
6,679,932 B2 1/2004 Birler et al.
6,702,905 B1 3/2004 Qiao et al.
6,712,871 B2 3/2004 Oh
6,783,568 B1 * 8/2004 Bowskill ..... C22C 33/0207 75/255
6,793,876 B2 9/2004 Kawakami et al.
6,802,883 B2 10/2004 Henmi et al.
6,951,579 B2 10/2005 Koyama
7,014,677 B2 3/2006 Takiguchi et al.
7,144,440 B2 12/2006 Ando
7,241,327 B2 7/2007 Henmi et al.
7,273,508 B2 9/2007 Sato et al.
7,300,490 B2 11/2007 Ozaki et al.
7,572,312 B2 8/2009 Kawata et al.
7,575,619 B2 8/2009 Kawata et al.
7,601,196 B2 10/2009 Kawata et al.
7,867,315 B2 1/2011 Yamamoto et al.
7,892,481 B2 2/2011 Yoshihiro et al.
8,032,761 B2 10/2011 Rodgers et al.
8,110,020 B2 2/2012 Bergman et al.
8,231,702 B2 7/2012 Bargman et al.
8,257,462 B2 9/2012 Christopherson, Jr. et al.
8,277,533 B2 10/2012 Farthing et al.
8,733,313 B2 5/2014 Sato et al.
8,801,828 B2 8/2014 Christopherson, Jr. et al.
8,876,936 B2 11/2014 Kim et al.
8,940,110 B2 1/2015 Qiao et al.
9,175,584 B2 11/2015 Lee et al.
9,334,547 B2 5/2016 Qiao et al.
9,359,921 B2 6/2016 Hashimoto et al.
9,556,761 B2 1/2017 Koyama et al.
9,803,268 B2 10/2017 Oshige et al.
9,932,867 B2 4/2018 Qiao et al.
9,950,369 B2 4/2018 Shinohara et al.
9,976,202 B2 5/2018 Ando et al.
10,036,287 B2 7/2018 Koyama et al.
10,058,922 B2 8/2018 Shinohara et al.
10,207,328 B2 2/2019 Takashita et al.
10,213,830 B2 2/2019 Shinohara et al.
10,232,438 B2 3/2019 Christopherson, Jr. et al.
10,233,793 B2 3/2019 Shimada et al.
10,272,496 B2 4/2019 Beerens et al.
10,273,838 B2 4/2019 Ikemi et al.
10,344,636 B2 7/2019 Hashimoto
10,428,700 B2 10/2019 Ikemi et al.
10,563,548 B2 2/2020 Hashimoto
10,584,618 B2 3/2020 Hashimoto
10,605,374 B2 3/2020 Takaki et al.
10,619,229 B2 4/2020 Shinohara et al.
10,661,344 B2 5/2020 Ohmori et al.
10,677,109 B2 6/2020 Qiao et al.
10,837,087 B2 11/2020 Beaulieu et al.
2001/0037842 A1 11/2001 Hayashi et al.
2002/0084004 A1 7/2002 Takahashi et al.
2003/0230164 A1 12/2003 Henmi et al.
2005/0193861 A1 9/2005 Sato et al.
2011/0023808 A1 2/2011 Sato et al.
2014/0076260 A1 * 3/2014 Qiao ..... C22C 33/0285 123/188.8
2017/0209928 A1 7/2017 Shinohara et al.
2018/0149280 A1 5/2018 Takaki et al.
2019/0381570 A1 12/2019 Heckendorn et al.
2020/0071803 A1 3/2020 Kim
2020/0216935 A1 7/2020 Beaulieu et al.
2022/0349487 A1 11/2022 Qiao et al.

FOREIGN PATENT DOCUMENTS

CN 101517110 A 8/2009
CN 107838413 A 3/2018
CN 112247140 A 1/2021
EP 1536028 A2 1/2005
EP 4082692 A1 11/2022
GB 2451898 A 2/2009
JP S61-64859 A 4/1986
JP S61-73867 A 4/1986
JP H1121659 A 1/1999
JP 2023067801 A 5/2023
KR 20120125817 A 11/2012
WO WO-2008017848 A1 * 2/2008 ..... C22C 38/52
WO 2009024809 A1 2/2009

OTHER PUBLICATIONS

Extended European Search Report mailed Aug. 31, 2022 in corresponding European Patent Application No. 22169809.5-1103, 7 pages.
First Office Action mailed Apr. 5, 2023 in corresponding Chinese Patent Application No. 202210433615.8, 9 pages.
Office Action (First Office Action) issued on Apr. 3, 2026, by the State Intellectual Property Office of the People's Republic of China in corresponding Chinese Patent Application No. 202311677906.2, and an English Translation of the Office Action. (15 pages).

* cited by examiner

SINTERED ENGINE PART AND METHOD OF MANUFACTURE THEREOF

BACKGROUND

Powder metallurgy (PM) valve seat insert (VSI) materials continuously face significant challenges for medium to heavy duty internal combustion (IC) engine VSI applications in terms of wear resistance, thermal shock resistance, fatigue cracking resistance, corrosion resistance, and insert retention capability. Iron-based sintered valve seat inserts typically have additions of intermetallic and/or silicide hard particles. Obtaining a uniform distribution of such hard particles can be difficult to achieve and the final product may have less than optimal properties due to the presence of such hard particles. For example, two commercial PM VSI materials, AP grade and S grade PM materials include high hardness particles such as tribaloy powder and VCN. One of them was made with double pressing and double sintering (2P2S) process while the other was made with single sintering plus copper infiltration process and; the one with 2P2S process significant overperformed the one made with sintering plus copper infiltrated process in multiple engine tests.

Copper infiltration can fill PM porosity and thus improve wear resistance when a VSI service temperature is not very high. Copper/copper alloy possess low melting temperature, low strength, and high affinity to many other metals/alloys compared to common iron-, nickel-, or cobalt-based alloys. Thus, at elevated temperature, a larger amount of copper infiltration can augment adhesive wear propensity and potentially degrade PM VSI material performance. For the same reason, infiltration copper formed with capillary reaction in thin waving sheet formation can effectively benefit wear resistance contrasted to chunky copper formation in a part through gravitational copper-fill.

Contemporary IC engine design must take into account high service temperature and pressure environments. Copper infiltrated VSI will increase heat transfer rate to carry out exhaust heat from valve to engine counterbore which lessens the temperature gradient in radial orientation for a VSI. Therefore, the maximum temperature in the contact surface between VSI OD and counterbore for a copper infiltrated VSI is higher than for a non-copper infiltrated VSI. As a result, a VSI with copper infiltration can possess a lower retention capability than non-copper-infiltrated version making it more sensitive to insert drop-out. The effect of copper infiltration on part retention capability is related to form and amount of copper in a PM VSI.

The most widely used PM bonding mechanism is diffusion bonding through a sintering process. The sintering process affects the bonding strength among neighboring powders in a PM material thus, has a significant effect on the material wear resistance. Double pressing and double sintering (2P2S) can increase the density and powder bonding strength. However, 2P2S will not able to alter uniformity of powder distribution along with the evident penalty of higher process cost. Therefore, there is a need for a desired bonding strength concept that should start with powder admix design, compacting condition, and adequate sintering parameters.

SUMMARY

In an embodiment, a powder admixture useful for making a sintered engine part comprises a first iron-base powder and second iron-base powder wherein the first iron-base powder has a higher hardness than the second iron-base powder, the first iron-base powder including, in weight percent (wt. %), 1-2% C, 10-25% Cr, 5-20% Mo, 15-25% Co, and 30-60 wt. % Fe, and the second iron-base powder including a vanadium-free tool steel, wherein the second iron-base powder further includes vanadium carbide particles present in an amount sufficient to reduce adhesive wear.

According to various options, (a) the first iron-base powder has a microstructure of interdendritic and intradendritic solidification substructures with up to 25% sigma phase; (b) the powder admixture further includes up to 20% Fe powder; (c) the powder admixture includes up to 3% Cu powder; (d) the powder admixture includes up to 2% MnS powder; (e) the powder admixture includes up to 2% die lubricant; (f) the first iron-base powder comprises, consists essentially or consists of 1-2% C, 10-25% Cr, 5-20% Mo, 15-25% Co, up to 1% Mn, up to 1% Si, up to 5% Ni, up to 5% W, up to 2% V, up to 0.5% B, up to 0.1% P, up to 0.1% S, up to 0.5% N, up to 5% Nb, balance 30-60% Fe and incidental impurities; (g) the second iron-base powder comprises, consists essentially or consists of, in weight %, 1-1.5% C, 3-15% Cr, 5-7% Mo, 3-6% W, up to 1% Mn, up to 1% Si, balance 60-85% Fe and incidental impurities and is optionally Ni-free, optionally Co-free, and optionally Nb-free; (h) the first iron-based powder is present in an amount of 40-60 wt. % and the second iron-based powder is present in an amount of 20-40 wt. %; (i) the powder admixture includes Fe powder, Cu powder and MnS powder, the first iron-based powder is present in an amount of 40-60 wt. %, the second iron-based powder is present in an amount of 20-40 wt. %, the Fe powder is present in an amount of 15-20 wt. %, the Cu powder is present in an amount of 1-3%, and the MnS powder is present in an amount of 0.1-1 wt. %; (j) the powder admixture is free of additive silicide, Mo-base, Co-base and intermetallic hard particle powders; (k) the first iron-base powder has a microstructure consisting of 40-60 vol. % interdendritic and 60-40 vol. % intradendritic regions; (1) other than the vanadium carbide particles, the powder admixture is free of other hard particle powders having a hardness greater than the hardness of the first iron-base powder; (m) the vanadium carbide particles have an average particle size of 1-150 microns; (n) the vanadium carbide particles are vanadium carbonitride particles having an average size of 1-150 microns; and/or (o) the vanadium carbide particles are present in an amount of 0.515 wt. %.

The powder admixture can be used to manufacture a sintered engine part such as a valve seat inert wherein the powder admixture has been compacted in the shape of an engine part, sintered to form a sintered powder admixture optionally infiltrated with copper.

According to various options, (a) the sintered powder admixture has a density of at least 7.5 g/cm$^3$; (b) the first iron-base powder has a microstructure consisting of 40-60 vol. % interdendritic and 60-40 vol. % intradendritic regions; (c) other than the vanadium carbide particles, the sintered admixture is free of hard particles having a hardness greater than the hardness of the first iron-base powder; (d) the sintered admixture is free of additive silicide, Mo-base, Co-base or intermetallic hard particle powders; (e) the first iron-based powder is present in an amount of 40-60 wt. %, the second iron-based powder is present in an amount of 20-40 wt. %, and Fe powder is present in an amount of 15-20 wt. %; and/or (f) the first iron-based powder is present in an amount of 40-60 wt. %, the second iron-based powder is present in an amount of 20-40 wt. %, Fe powder is present in an amount of 15-20 wt. % and copper is present in an amount of 10-15 wt. %.

A method of manufacturing the sintered engine part can comprise forming an admixture by mixing the first iron-based powder with the second iron-based powder, compacting the admixture, and sintering the admixture.

According to various options, (a) the sintering comprises preheating the powder admixture at 560° C., 850° C., and 950° C. for 5-20 minutes followed by 1120° C. sintering for 40-60 minutes; (b) the sintering comprises a double pressing and double sintering process; (c) subjecting the sintered part to cryogenic treatment in liquid nitrogen; (d) subjecting the sintered part to a steam treatment; and/or (e) the sintering is carried out while infiltrating the admixture with copper.

DETAILED DESCRIPTION

Figure 1:
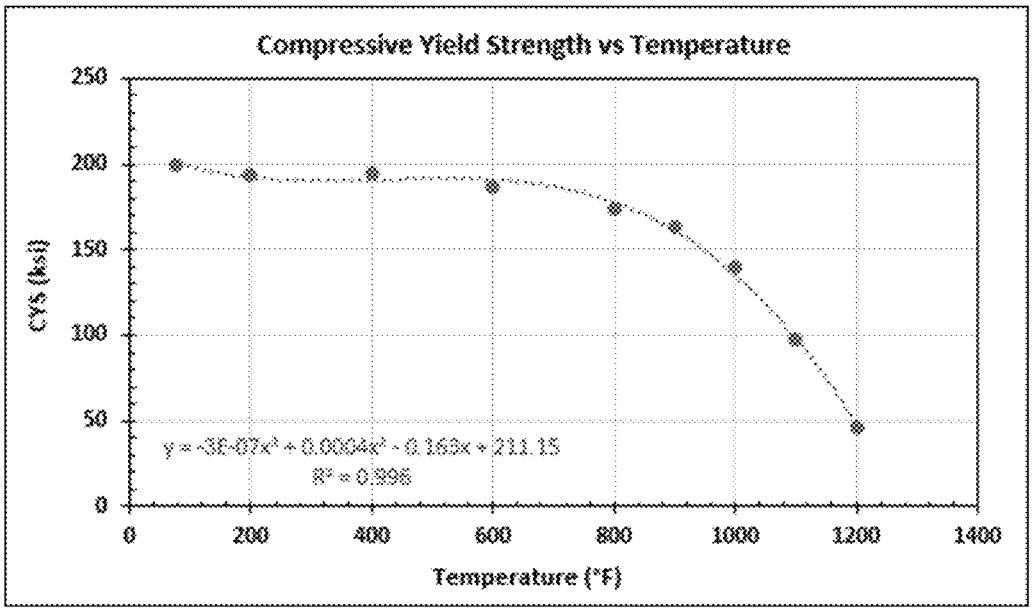
FIG. 1 is a graph of compressive yield strength versus temperature and FIG. 2 is a graph of ultimate tensile rupture strength versus temperature for a sintered part.

Disclosed herein is a powder metal material (referred to herein as "JP513VC") which eliminates the need to include hard intermetallic/silicide hard particles by using an admixture of two iron-base powders. JP513VC includes two iron-base powders which can be pressed and sintered to form engine parts such as valve seat inserts or other parts suitable for medium- and heavy-duty engine applications.

One of the key factors affecting PM VSI performance is compact density. Performance issues relating to wear resistance, cracking resistance, and retention capability of a PM VSI can be traced to the compact density/density distribution which is associated with powder admixing process, powder shape, uniformity and size distribution of the powders. Therefore, it is desirable to achieve sound density and desired density distribution for a heavy-duty PM material design and manufacturing.

Copper infiltration can fill PM porosity thus improve wear resistance when a VSI service temperature is not very high. Copper and copper alloys typically have a relatively low melting temperature, low strength, and high affinity to many other metals/alloys. Thus, such copper or copper alloys can affect adhesive wear propensity and have a significant impact on PM VSI material performance. For the same reason, infiltration copper formed with capillary reaction in thin waving sheet formation can effectively benefit wear resistance as compared to chunky copper formation in a part through gravitational copper-fill.

Contemporary IC engine design requires consideration of high service temperature and pressure. A copper infiltrated VSI will increase the heat transfer rate to carry out exhaust heat from valve to engine counterbore which lessens the temperature gradient in radial orientation for a VSI. Therefore, the maximum temperature on the contact surfaces between VSI OD and engine cylinder head counterbore for a copper infiltrated VSI is higher than a non-copper infiltrated version an engine. As a result, a VSI with copper infiltration can possess a lower retention capability than non-copper-infiltrated version and is more sensitive to insert drop-out. The effect of copper infiltration on part retention capability is related to form and amount of copper in a PM VSI.

The most widely used PM powder bonding mechanism is diffusion bonding through a sintering process. The sintering process affects the bonding strength among neighboring powders in a PM material thus, has a significant effect on the material wear resistance. Double pressing and double sintering (2P2S) can increase the density and powder bonding strength. However, 2P2S will not be able to alter uniformity of powder distribution along with the evident penalty of higher process cost. Therefore, a desired bonding strength should start with powder admix design, compacting condition, and adequate sintering parameters.

Additive copper powder can be used to create transient liquid phase formation during a sintering process to diffuse into the iron and iron-base powders during the initial stage of sintering process. The melting point of copper is 1083° C. which is lower than typical sintering temperatures (e.g., 1120° C.). At the initial sintering process, the iron-base powders possess high copper solubility. The level and amount of copper diffusion in the iron-base powders is related to sintering temperature and duration. The copper diffusion into the iron-base powders can assist bonding between the iron-base powders and the other additive powders, i.e. additive copper can effectively assist bonding formation between the iron-base powders and other additive powders through a transient liquid phase sintering process. In addition, the iron-base powders with diffusion copper augment the hardenability of the sintered material. When the copper diffusion process stops, any remaining copper liquid can fill the gaps formed between compacted powders via a process that thermodynamically minimizes the free enthalpy of interfaces. Combined with properly designed compact density and density distribution, the admixed copper powder approach can reduce the amount of PM porosities and form stronger bonding compared to the effect from infiltrated copper.

In JP513VC, up to 20 wt. % (e.g., 15-20 wt. %, 16-19 wt. %, 17-18 wt. %) pure iron powder can be included as a binder powder for which copper's solubility is up to 10 wt. %. The copper can diffuse into the iron powder and thereby increase the strength of pure iron powder to minimize strength variation between powders and powder boundaries.

Steam treatment can be a very cost-effective process for iron-based powder materials used in VSI non-copper infiltration applications Like the copper infiltration process, the optimal effect to a PM VSI material of a steam treatment process is directly related to the PM apparent density, specifically the PM porosity size, shape, and distribution. The iron oxides formed during steam treatment can benefit the PM wear performance. However, a significant amount of iron oxide formation can degrade the bonding formed between powder particles.

The JP513VC powder admixture can include 40-60 wt. % (e.g., 45-55 wt. %, 48-52 wt. %, 50 wt. %) of a first iron-base powder and 20-40 wt. % (e.g., 25-35 wt. %, 28-32 wt. %, 30 wt. %) of a second iron-base powder. Both of the iron-base powders can have the same particle size range but differ in compositions. The first iron-base powder can include, in weight (wt.) %, 1-2% C, 10-25% Cr, 5-20% Mo, 15-25% Co and 30-60% Fe whereas the second iron-base powder can include vanadium carbide particles and a vanadium-free tool steel comprising 1-1.5% C, 3-15% Cr, 5-7% Mo, 3-6% W, and 60-85% Fe. The JP513VC powder admixture can also include up to 20% pure Fe, up to 3% Cu powder, a machinability enhancing additive such as MnS powder and a die lubricant such as Zn stearate. As an example, the admixture can include 50% of the first iron-base powder, 30% of the second iron-base powder, 17% of the pure Fe powder, 2% Cu powder, 0.5% MnS powder and 0.5% die lubricant. VC carbide most likely has the highest hardness among common metal carbides used in the PM industry. It possesses a very high melting point (18 2810° C. and chemical stability. Hence, it can be one of the ideal metal carbide particles added to a PM material to enhance the material's wear and corrosion resistant performance at ambient and elevated temperature. The vanadium carbide particles can be vanadium carbide (VC) and/or vanadium carbonitride (VCN) particles present in an amount of 0.5-5 wt. % of the second iron base powder and have an average particle size of 1-150 microns. Due to the high melting point of vanadium carbide particles, they can be distributed in the powder admixture more uniformly and with more unform particle size than vanadium carbide precipitates formed from a tool steel composition containing carbon and vanadium.

The first iron-base powder can be an atomized powder which has been annealed and preferably does not go through significant phase transformation after sintering. However, the first iron-base powder may undergo some bainitic phase transformation during cooling down period after sintering process (e.g., 1120° C. sintering) which starts at about 235° C. and is completed at about 165° C. within a cooling rate between 1° C./min through 6° C./min. The second iron-base powder preferably goes through a martensitic phase transformation during cooling down period from a sintering process (e.g., 1120° C. sintering) which starts at about 245° C. (Ms) and finishes at about −10° C. (MO. Therefore, a sub-zero cryogenic treatment will benefit JP513VCVC materials properties such as dimensional stability, fatigue strength, and VSI retention capability.

During sintering, the JP513VC powder admixture can be optionally infiltrated with copper. Based upon capillary force fundamentals, "thin" porosity in the compacted powder is preferred for a copper infiltration process. In an example, near spherical or ellipsoid powder can be used for the first iron-base powder and the compacted powder can be infiltrated with approximately 13 wt. % infiltration copper. With thin gap formation among the powder particulates after compacting, copper infiltration can be beneficial to engine part performance.

The JP513VC powder admixture can be subjected to a hot forging application. The concept of applying a powder metal forging process is to substantially increase the component density to near 100% theoretic number. Thus, by using a malleable powder as the second iron-base powder and a powder which is not suitable for hot forging as the first iron-base powder, the admixture can be hot forged to a desired density. From the same considerations, JP513VC powder admixture can be used to apply metal injection molding (MIM) process.

During compaction, the first iron-base powder is preferably not significantly deformed under compacting force while the second iron-base and pure iron powders are significantly deformed which allows a good bonding formation between the powders. Diffusion of copper phase can take place which assists the bonding between powders.

The shape of MnS powder can significantly vary depending upon where the MnS powder is located. With 17 wt. % of pure iron powder, the iron powder can be completely joined with all powder types present in the JP513VC admixture. Significant amounts of infiltration copper can penetrate through gaps between pure iron powders likely due to a higher capillary force existing between pure iron particulates. Fine particles in the second iron-base powder can be molybdenum and chromium rich carbides. The size and distribution of the Mo and Cr rich carbides can be formed during the powder atomization process.

The apparent hardness of sintered JP513VC can be about HRc 49 which makes JP513VC suitable for heavy duty intake and exhaust engine VSI applications. The JP513VC powder admixture when subjected to steam treatment can enhance the materials tribo performance especially if not infiltrated with copper.

JP513VC sintered engine parts can be manufactured using a conventional compacting and sintering process. The JP513VC powder admixture concept preferably includes two iron-base powders, iron binder powder, and additive powders to enhance processing ability and intended engineering application performance. The JP513VC powder includes a high hardness first iron-base powder with spherical and/or ellipsoid shapes combined with a malleable softer second iron-base powder to provide JP513VC with high apparent density PM engineering parts for high wear resistance applications. The bonding among the two iron-base powders, iron binder powder, solid lubrication powder and additive copper powder is preferably sound with high sintered density (>7.5 g/cm$^3$). Moreover, admix capability of JP513VC with the desired powder characteristics and distribution can provide a very uniform powder mixing condition which can achieve the desired high materials performance.

The softer second iron-base powder and pure iron powders are irregular shaped. So, both the second iron-based powder and pure iron powder can be deformed during the compacting process such that they surround the harder first iron-based powder.

Other than the vanadium carbide particles added to the second iron-base powder, no other hard particles/powders, e.g., additive silicide, intermetallic, Mo-based, Co-based and Fe—Mo hard particle powders, are added to the powder admixture. The harder first iron-base powder has a percentage of iron rich intermetallic phases, Fe—Co solid solution phases plus a bainitic (with or without a small amount of martensite) structure which provides significant wear resistance. After compaction and sintering, the harder first iron-base powder can be present in a high percentage with uniform three dimensional distribution and the softer second iron-based powder and solid solution strengthened iron portion (after sintering) can provide the admixture with toughness needed for engineering applications along with improved wear resistance (for example, reduce adhesive wear).

The harder first iron-base powder includes intermetallic sigma phase and carbides which remain in the microstructure at the sintering temperature. Copper diffusion into the harder first iron-base powder is minimal and whereas copper diffused into pure iron and the softer second iron-base powder can potentially form 6-copper in the second iron-base powder inducing precipitation hardening effect and as solute to have a solid solution strengthening effect for pure iron.

In an embodiment, a powder admixture useful for making a sintered engine part such as a valve seat insert comprises a first iron-base powder and second iron-base powder wherein the first iron-base powder has a higher hardness than the second iron-base powder, the first iron-base powder including, in weight percent, 1-2% C, 10-25% Cr, 5-20% Mo, 15-25% Co, and 30-60 wt. % Fe, and the second iron-base powder including a vanadium-free tool steel powder, wherein the second iron-base powder further includes vanadium carbide particles in an amount sufficient to reduce adhesive wear. According to various options, (a) the first iron-base powder has a microstructure of interdendritic and intradendritic solidification substructures with up to 25% sigma phase; (b) the powder admixture further includes up to 20% Fe powder; (c) the powder admixture includes up to 3% Cu powder; (d) the powder admixture includes up to 2%

MnS powder; (e) the powder admixture includes up to 2% die lubricant; (f) the first iron-base powder comprises, consists essentially or consists of 1-2% C, 10-25% Cr, 5-20% Mo, 15-25% Co, up to 1% Mn, up to 1% Si, up to 5% Ni, up to 5% W, up to 2% V, up to 0.5% B, up to 0.1% P, up to 0.1% S, up to 0.5% N, up to 5% Nb, balance 30-60% Fe and incidental impurities; (g) the vanadium-free tool steel of the second iron-base powder comprises, consists essentially or consists of 1-1.5% C, 3-15% Cr, 5-7% Mo, 3-6% W, up to 1% Mn, up to 1% Si, balance 60-85% Fe and incidental impurities, and is optionally Ni-free, optionally Co-free, and optionally Nb-free; (h) the first iron-based powder is present in an amount of 40-60 wt. % and the second iron-based powder is present in an amount of 20-40 wt. %; (i) the powder admixture includes Fe powder, Cu powder and MnS powder, the first iron-based powder is present in an amount of 40-60 wt. %, the second iron-based powder is present in an amount of 20-40 wt. %, the Fe powder is present in an amount of 15-20 wt. %, the Cu powder is present in an amount of 1-3%, and the MnS powder is present in an amount of 0.1-1 wt. %; (j) the powder admixture is free of additive silicide, Mo-base, Co-base and intermetallic hard powder particles; (k) the first iron-base powder has a microstructure consisting of 40-60 vol. % interdendritic and 60-40 vol. % intradendritic regions; and/or (1) the powder admixture is free of Co-base, Mo-base, or intermetallic hard particle powders having a hardness greater than the hardness of the first iron-base powder.

The powder admixture can be used to manufacture a sintered engine part such as a valve seat inert wherein the powder admixture is compacted in the shape of an engine part, sintered to form a sintered powder admixture optionally infiltrated with copper. According to various options, (a) the sintered powder admixture can have a density of at least 7.5 g/cm$^3$; (b) the first iron-base powder can have a microstructure consisting of 40-60 vol. % interdendritic and 60-40 vol. % intradendritic regions; (c) the sintered admixture can be free of hard particles having a hardness greater than the hardness of the first iron-base powder; (d) the sintered admixture can be free of silicide, Mo-base, Co-base or intermetallic hard particles; (e) the first iron-based powder can be present in an amount of 40-60 wt. %, the second iron-based powder can be present in an amount of 20-40 wt. %, and Fe powder can be present in an amount of 15-20 wt. %; and/or (f) the first iron-based powder can be present in an amount of 40-60 wt. %, the second iron-based powder can be present in an amount of 20-40 wt. %, Fe powder can be present in an amount of 15-20 wt. % and copper can be present in an amount of 10-15 wt. %.

A method of manufacturing a sintered engine part such as a valve seat insert can comprise forming an admixture by mixing the first iron-based powder with the second iron-based powder, compacting the admixture, and sintering the admixture. According to various options, (a) the sintering can comprise preheating the powder admixture at 560° C., 850° C., and 950° C. for 5-20 minutes followed by 1120° C. sintering for 40-60 minutes; (b) the sintering can comprise a pressing and sintering process; (c) subjecting the sintered part to cryogenic treatment in liquid nitrogen; (d) subjecting the sintered part to a steam treatment; and/or (e) the sintering can be carried out while infiltrating the admixture with copper.

EXAMPLE

JP513VC can be made from an admixture set forth in Table 1 of the following powders in which the harder first iron-base powder is designated as "P1" and the softer second iron-base powder is designated as "P2":

TABLE 1

| Powder | Condition | Target mesh size | Target mm size | Wt. % |
|---|---|---|---|---|
| P1 | Water atomized | 120 | 0.125 | 50 |
| P2 | Water atomized V-free tool steel with added VC particles | 120 | 0.125 | 30 |
| Pure Fe | Reduced Fe | 80 | 0.177 | 17 |
| Pure Cu | electrolytic | 200 | 0.074 | 2 |
| Die lubricant | commercial | <35 | <0.5 | 0.5 |
| MnS | commercial | 325 | 0.044 | 0.5 |

The JP513VC powder metal part design preferably comprises an admixture of a hard iron-base powder (P1) containing intermetallic phases including sigma phase, a softer iron-base powder with a vanadium-free tool steel composition including VC particles, pure iron, additive copper, solid lubricant along with copper infiltration. The sintered part can be infiltrated with 13 wt. % or 18 wt. % copper. In an example, the first and second iron-base powders can be admixed with weight ratio of 1.67 (50 wt. % first iron-base powder to 30 wt. % second iron-base powder).

In this example, the powder admixture can include 50 wt. % of the first iron-base powder, 30 wt. % of the second iron-base powder, 0.5 wt. % lubricant, 0.5 wt. % of MnS, 17 wt. % of reduced iron powder, and 2 wt. % of additive copper.

Parts can be made using a standard sintering time including preheat (48 minutes) at 560° C., 850° C. and 950° C. for 16 minutes at each temperature and sintering for 48 minutes at 1120° C. Cryogenic treatment of 15 minutes immersion in liquid nitrogen can be applied prior to tempering at 538° C. for one hour.

An admixture of P1 (50 wt. %) with vanadium-free tool steel powders P2 (30 wt. %) can show a very similar apparent density. The amount of copper infiltration at 13 wt. % and 18 wt. % should not affect the internal microstructure for vanadium-free tool steel powders. Excess copper can form on the bottom face surface with 18 wt. % of copper infiltration. However, copper infiltration may reach a desired level at approximate 14.5 wt. %. The apparent density of the samples should be sound with no large PM porosity. P1 alloy powder can be uniformly distributed in the admixture with P2, pure iron, and the other additive powders. The spherical or ellipsoidal shaped P1 powder can be very beneficial to the PM materials wear resistance with good bonding between P1 and P2 iron-base powders. The amount of copper infiltration should be sufficient from surface to the center of sintered parts with surface PM porosities fully filled with copper.

Microhardness mapping with 500 g applied load for all six types of JP513VC samples reveals a sound apparent microhardness distribution. In general, samples with 13 wt. % copper infiltration show a lower hardness under a 500 g load which is most likely related PM compact density and PM porosity density which was not fully filled by copper infiltration.

The P1 powder can be considered a hardening treatable alloy in that solid phase transformation can take place with only a small portion of the alloy going through a solid state phase transformation. In the as-hardened condition (1700° F.), the P1 powder can have an increased interdendritic region and decreased intradendritic region compared to the same alloy in an as-cast condition. The increase in interdendritic region is through a diffusion process between the interdendritic and intradendritic regions at elevated temperature such as hardening at 1700° F. It is estimated that about 25 vol. % of the interdendritic region is sigma phase and about 25 vol. % of intradendritic region is sigma phase. It is also estimated that about 75 vol. % of high Cr high-Mo ferrite exists in the interdendritic region and about 75 vol. % of γFe,αCo solid solution (fcc) phase exists in the intradendritic region.

Thus, the P1 powder in a hardened or hardened+tempered condition with 50 vol. % intradendritic and 50 vol. % interdendritic regions, the microstructure may contain up to about 37.5 vol. % of high Cr and Mo ferrite phase, up to about 37.5 vol. % of γFe,αCo solid solution (fcc) phase, up to about 25.0 vol. % of sigma phase with the balance up to about 5.0 vol. % of a mixture of bainite, martensite, and carbide phases.

In an embodiment, a sintered engine part (for example, valve seat insert, valve guide, turbocharger component, bushing, friction pad, or the like) can be manufactured by preparing a powder admixture of, in weight %, 40-60 wt. % of the first iron-base powder, 20-40 wt. % of the second iron-base powder, 15-25 wt. % pure iron powder, optionally up to 5 wt. % copper powder, optionally up to 5 wt. % manganese sulfide and optionally up to 5 wt. % die lubricant. The powder admixture can be compacted into the shape of an engine part suitable for use in internal combustion engines and sintered (e.g., single pressing and sintering or double pressing and sintering) with or without copper infiltration. The sintered part can be subjected to a cryogenic treatment to modify the microstructure of the sintered part. During sintering, the iron powder can diffuse into the second iron-base powder and/or elements such as Cu, Cr and Mo from other powders can diffuse into the iron powder. The vanadium carbide particles in the second iron-base powder can be more uniformly distributed with a desired particle size than vanadium carbide precipitates in the case of a second iron-base power containing vanadium which can combine with carbon to form vanadium carbide precipitates during sintering and/or heat treatment of the sintered part.

In the sintered part, the first iron-base powder can include sigma phase in the interdendritic and intradendritic regions. For example, up to 30 vol. % sigma phase (e.g., 20-30 vol. % sigma phase) can be present in the interdendritic region and up to 30 vol. % sigma phase (e.g., 20-30 vol. % sigma phase) can be present in the intradendritic region. With an addition of 40-60 wt. % of the first iron-base powder to the powder admixture, the sintered part can contain 8-18 vol. % sigma phase (e.g., 10-15 vol. % sigma phase).

In the sintered part, the first iron-base powder can include an iron-cobalt (Fe—Co) face centered cubic (FCC) solid solution phase. For example, the intradendritic region can include 60-90 vol. % (e.g., 70-80 vol. %) Fe—Co solid solution phase. With an addition of 40-60 wt. % of the first iron-base powder to the powder admixture, the sintered part can contain 10-30 vol. % Fe—Co solid solution phase (e.g., 15-25 vol. % Fe—Co solid solution)

In the sintered part, the first iron-base powder can include ferrite (e.g., high chromium ferrite) in the interdendritic region. For example, up to 60-90 vol. % ferrite (e.g., 70-80 vol. % ferrite) can be present in the interdendritic region. With an addition of 40-60 wt. % of the first iron-base powder to the powder admixture, the sintered part can contain 10-30 vol. % high chromium ferrite phase (e.g., 15-25 vol. % high chromium ferrite).

In the sintered part, the second iron-base powder can include 70-80 vol. % (e.g., about 75 vol. %) of tempered martensite and 20-30 vol. % (e.g., about 25 vol. %) of chromium-molybdenum carbide. With the addition of 20-40 wt. % of the second iron-base powder to the powder admixture, the sintered part can contain 10-30 vol. % tempered martensite and 5-10 vol. % chromium-molybdenum carbide.

For pure iron powder, a significant elemental diffusion process occurs during a sintering process. Depending upon post sintering treatment conditions, the pure iron powder can be composed of ferrite, bainite, martensite or their combinations. In addition, the sintered part can be subjected to a liquid nitrogen cryogenic treatment. In that case, greater than 90 vol. % of the combined pure iron powder/second iron-base powder can be composed of tempered martensitic phase along with up to 10 vol. % of ferrite, or bainite, or ferrite+bainite. In the sintered part, the pure iron powder can include up to 10 vol. % ferrite (or bainite or bainite plus ferrite). Thus, with an addition of 10-20 wt. % of the pure iron powder to the powder admixture, the sintered part can contain 1-2% ferrite, bainite or ferrite plus bainite.

The sintered engine part such as a VSI can be heat treated via a hardening and tempering treatment to provide a tempered martensitic microstructure. For example, the sintered and heat treated engine part sch as a VSI can include at least 25 vol. % (e.g., 30-40 vol. %) tempered martensite.

In an example, the sintered and heat treated engine part such as a VSI can include 10-15 vol. % (e.g., 12-13 vol. %) sigma phase, 30-40 vol. % (e.g., 34-36 vol. %) martensite, 20-25 vol. % (e.g., 21-23 vol. %) ferrite, up to 2 vol. % bainite, 20-25 vol. % (e.g., 21-23 vol. %) iron-cobalt solid solution phase, and 5-10 vol. % of high chromium carbides.

In the forgoing example, J120 was used as a P2 powder. J120 includes, in weight %, 1.2-1.5% C, 0.3-0.6% Mn, 0.3-0.6% Si, 3.5-4.25% Cr, 6-7% Mo, 5-6% W, balance Fe.

Figure 2:
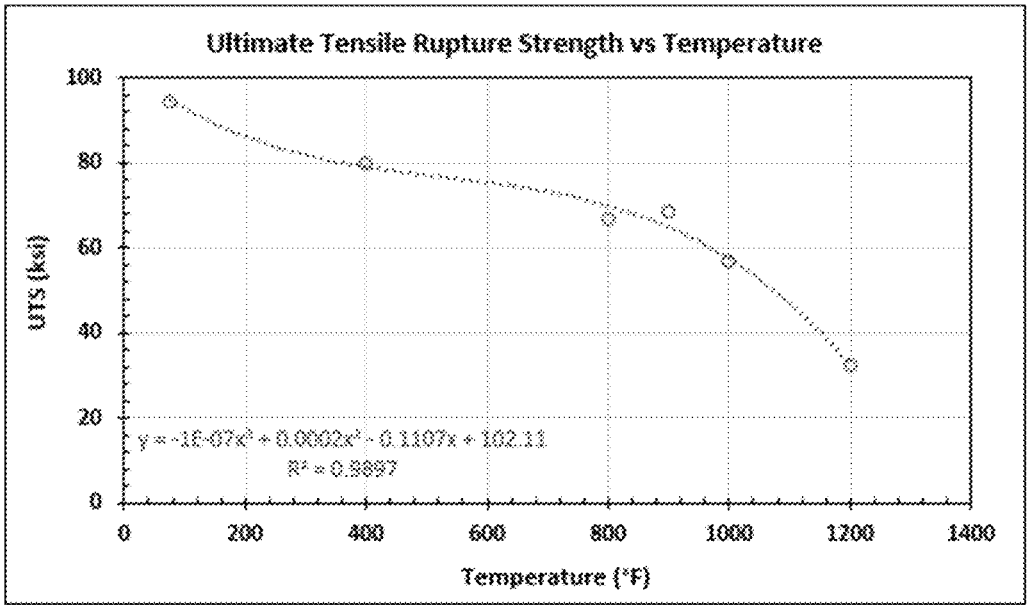

JP513VC when sintered and heat treated can have high compressive strength and ultimate tensile rupture strength at elevated temperatures as shown in FIGS. 1 and 2.

FIG. 1 is a graph of compressive yield strength versus temperature of JP513VC in which the values of compressive yield strength (CYS) are in units of ksi, as shown in Table 2 below.

TABLE 2

| Temperature ° F. | CYS (ksi) |
|---|---|
| 75 | 199.3 |
| 200 | 194.2 |
| 400 | 194.3 |
| 600 | 186.5 |
| 800 | 173.8 |
| 900 | 163.3 |
| 1000 | 140.2 |
| 1100 | 97.7 |
| 1200 | 46.5 |

FIG. 2 is a graph of ultimate tensile rupture strength (UTS) versus temperature of JP513VC in which the values of UTS are in units of ksi, as shown in Table 3 below.

TABLE 3

| Temperature ° F. | UTS (ksi) |
|---|---|
| 75 | 94.6 |
| 400 | 79.6 |
| 800 | 66.7 |

TABLE 3-continued

| Temperature ° F. | UTS (ksi) |
|---|---|
| 900 | 68.3 |
| 1000 | 56.8 |
| 1200 | 32.2 |

As shown by the graphs in FIGS. 1 and 2 and the data in Tables 2 and 3, JP513VC exhibits high CYS and UTS from ambient (75° F.) to about 800° F.

The preferred embodiments are merely illustrative and should not be considered restrictive in any way. The scope of the invention is given by the appended claims, rather than the preceding description, and all variations and equivalents which fall within the range of the claims are intended to be embraced therein.

What is claimed is:

1. A powder admixture useful for making a sintered engine part, the powder admixture comprising a first iron-base powder and second iron-base powder wherein the first iron-base powder has a higher hardness than the second iron-base powder, the first iron-base powder including, in weight percent wt. %, 1-2% C, 10-25% Cr, 5-20% Mo, 15-25% Co, and 30-60% Fe, and the second iron-base powder including a vanadium-free tool steel powder, wherein the second iron-base powder further includes vanadium carbide particles in an amount sufficient to reduce adhesive wear.

2. The powder admixture of claim 1, wherein (a) the first iron-base powder has a microstructure of interdendritic and intradendritic phases with up to 25 volume percent (vol. %) sigma phase, (b) the powder admixture further includes, in wt. %, up to 20% Fe powder, up to 3% Cu powder, up to 2% MnS powder, and up to 2% die lubricant, (c) the first iron-base powder consists essentially of, in wt. %, 1-2% C, 10-25% Cr, 5-20% Mo, 15-25% Co, up to 1% Mn, up to 1% Si, up to 5% Ni, up to 5% W, up to 2% V, up to 0.5% B, up to 0.1% P, up to 0.1% S, up to 0.5% N, up to 5% Nb, balance 30-60% Fe and incidental impurities and/or (d) the vanadium-free tool steel of the second iron-base powder consists essentially of, in wt. %, 1-1.5% C, 3-15% Cr, 5-7% Mo, 3-6% W, up to 1% Mn, up to 1% Si, balance 60-85% Fe and incidental impurities, and is optionally Ni-free, optionally Co-free, and optionally Nb-free.

3. The powder admixture of claim 1, wherein the vanadium carbide particles have an average particle size of 1 to 150 microns.

4. The powder admixture of claim 1, wherein the vanadium carbide particles are vanadium carbonitride particles having an average particle size of 1 to 150 microns.

5. The powder admixture of claim 1, wherein the vanadium carbide particles are present in an amount of 0.5 to 5 wt. % of the second iron-base powder.

6. The powder admixture of claim 1, wherein the first iron-based powder is present in an amount of 40-60 wt. % and the second iron-based powder is present in an amount of 20-40 wt. %.

7. The powder admixture of claim 1, wherein the powder admixture further includes Fe powder, Cu powder and MnS powder, the first iron-based powder is present in an amount of 40-60 wt. %, the second iron-based powder is present in an amount of 20-40 wt. %, the Fe powder is present in an amount of 15-20 wt. %, the Cu powder is present in an amount of 1-3%, and the MnS powder is present in an amount of 0.1-1 wt. %.

8. The powder admixture of claim 1, wherein other than the vanadium carbide particles, the powder admixture is free of additive silicide and intermetallic hard powder particles.

9. The powder admixture of claim 1, wherein the first iron-base powder has a microstructure consisting of 40-60 vol. % interdendritic and 60-40 vol. % intradendritic regions.

10. The powder admixture of claim 1, wherein other than the vanadium carbide particles, the powder admixture is free of Co-base and/or Mo-base particle powders having a hardness greater than the hardness of the first iron-base powder.

11. A sintered engine part comprising the powder admixture of claim 1, wherein the powder admixture has been compacted in the shape of an engine part, sintered to form a sintered powder admixture optionally infiltrated with copper.

12. The sintered engine part of claim 11, wherein the sintered powder admixture has a density of at least 7.5 $g/cm^3$.

13. The sintered engine part of claim 11, wherein the first iron-base powder has a microstructure consisting of 40-60 vol. % interdendritic and 60-40 vol. % intradendritic regions.

14. The sintered engine part of claim 11, wherein other than the vanadium carbide particles, the sintered admixture is free of silicide particle powders or intermetallic hard particle powders having a hardness greater than the hardness of the first iron-base powder.

15. The sintered engine part of claim 11, wherein the sintered admixture is free of additive silicide particle powders, Mo-base particle powders, Co-base particle powders or intermetallic hard particle powders.

16. The sintered engine part of claim 11, wherein the first iron-based powder is present in an amount of 40-60 wt. %, the second iron-based powder is present in an amount of 20-40 wt. %, and Fe powder is present in an amount of 15-20 wt. %.

17. The sintered engine part of claim 11, wherein the first iron-based powder is present in an amount of 40-60 wt. %, the second iron-based powder is present in an amount of 20-40 wt. %, Fe powder is present in an amount of 15-20 wt. % and copper is present in an amount of 10-15 wt. %.

18. A method of manufacturing the sintered engine part of claim 11, comprising forming an admixture by mixing the first iron-based powder with the second iron-based powder, compacting the admixture, and sintering the admixture.

19. The method of claim 18, wherein the sintering comprises preheating the powder admixture at 560° C., 850° C., and 950° C. for 16 minutes at each temperature followed by 1120° C. sintering for 48 minutes.

20. The method of claim 18, wherein (a) the sintering comprises a pressing and sintering process; (b) the method further comprising subjecting the sintered engine part to cryogenic treatment in liquid nitrogen; (c) the method further comprising subjecting the sintered engine part to a steam treatment; and/or (e) the sintering is carried out while infiltrating the admixture with copper.

* * * * *